US009676223B2

(12) United States Patent
Zhu et al.

(10) Patent No.: US 9,676,223 B2
(45) Date of Patent: Jun. 13, 2017

(54) SECURE DOCUMENT RECEPTACLE

(71) Applicants: Shengbo Zhu, San Jose, CA (US); Su Shiong Huang, Bellevue, WA (US)

(72) Inventors: Shengbo Zhu, San Jose, CA (US); Su Shiong Huang, Bellevue, WA (US)

(73) Assignee: MICRODATA CORPORATION, San Jose, CA (US)

( * ) Notice: Subject to any disclaimer, the term of this patent is extended or adjusted under 35 U.S.C. 154(b) by 0 days.

(21) Appl. No.: 14/756,562

(22) Filed: Sep. 17, 2015

(65) Prior Publication Data

US 2017/0080743 A1 Mar. 23, 2017

(51) Int. Cl.
*B42F 15/00* (2006.01)

(52) U.S. Cl.
CPC ..... *B42F 15/0088* (2013.01); *B42F 15/0011* (2013.01)

(58) Field of Classification Search
CPC .. B42F 15/0035; B42F 15/04; B42F 15/0088; B42F 15/0011; B31B 19/00; B42C 7/001; B42C 7/002
USPC ..... 229/67.1, 67.2, 67.4
See application file for complete search history.

(56) References Cited

U.S. PATENT DOCUMENTS 3,885,726 A * 5/1975 Fridlund ..... B42F 15/04 229/67.2
5,226,676 A * 7/1993 Su ..... B42F 9/007 229/67.1
5,226,734 A * 7/1993 Scott ..... B42F 21/065 229/67.2
5,707,001 A * 1/1998 Mark ..... B42F 15/0035 229/67.2
5,944,423 A * 8/1999 Rabin ..... B42F 15/0035 229/67.2
6,039,473 A * 3/2000 Bond ..... B42F 15/04 190/120
6,248,050 B1 * 6/2001 Boy ..... B42C 7/001 383/22
2009/0101605 A1 * 4/2009 Goodfellow ..... B42F 15/0064 211/46
2010/0072264 A1 * 3/2010 Dodson ..... B42F 15/0035 229/67.2
2013/0119120 A1 * 5/2013 Dobson ..... B42F 15/00 229/67.2
2014/0252074 A1 * 9/2014 Christensen ..... B42C 7/002 229/67.1

* cited by examiner

*Primary Examiner* — Peter Helvey

(57) ABSTRACT

A secure document receptacle for use in file cabinets having slidable drawers with laterally spaced support rails for removable supporting file folders. The secure document receptacle has a single support brace along the top edge with downwardly opening channels for removable engagement with the drawer support rails. The receptacle has a closed top edge and openings to the interior of the receptacle on the side edge or the bottom edge of the receptacle. Documents can only be inserted and removed via the open side or bottom edges. The receptacle must be partially or completely removed from the drawer support rails before a document can be removed from the receptacle. This interrupts contact between the brace channels and the support rails, an event which can be detected by cabinet sensing circuitry.

8 Claims, 4 Drawing Sheets

SECURE DOCUMENT RECEPTACLE

BACKGROUND OF THE INVENTION

This invention relates to document retention in general, and more specifically to document storage and retrieval.

Individual documents are commonly retrievably stored in file folders designed to be removably installed in filing cabinets having one or more drawers slidably mounted therein, with each drawer having a laterally spaced pair of upper support rails for accommodating the individual file folders. FIG. 1 is a perspective view, taken from the right front, of a typical multiple drawer filing cabinet in which known document file folders are retrievably stored. As seen in this Fig., a multiple drawer file cabinet 10 (four drawers illustrated) of known mechanical construction has the usual top 12, bottom 13, sides 14, 15, and back 16. Four drawers 18-21 are slidably mounted in cabinet 10, each drawer 18-21 having a drawer pull 23 mounted on a front panel 25 thereof. A visible indicator device 27 is also mounted on the front panel 25 of each drawer 18-21. Indicator 27 may comprise any one of a number of known elements capable of providing a visible signal when activated.

Lowermost drawer 18 is shown in the opened position in order to provide a perspective view of the basic drawer structure and the manner in which a file folder is removably supported in a file drawer. As shown, drawer 18 is provided with a pair of upper support rails 28, 29, which serve the primary purpose of supporting individual file folders, such as file folder 30, in the drawer. Secondarily, rails 28, 29 may also provide structural rigidity for the drawer 18 itself. Drawer 18 also has a pair of lower rails 32, 33 (only one of which is visible in FIG. 1) which complete the horizontal structural elements. In a commonly used file cabinet structure, rails 28, 29, 32, and 33 may form an inner frame insert (along with vertically arranged frame members) which can be physically installed in a standard drawer. To complete the drawer structure, a back 34 is connected to the rails 28, 29, 32, 33. All file folders, such as folder 30, are removably supported by upper rails 28, 29 using horizontal support braces (described below) to which the folder 30 is mechanically secured. The mechanical structure of folder 30 and rails 28, 29 is conventional. The structure and arrangement of drawers 19-21 are identical to that of drawer 18.

FIG. 2 is a perspective view of a typical file folder 30. As seen in this Fig., file folder 30 is a document receptacle formed from a single sheet of suitable material (typically durable paper stock) folded about the longitudinal center. Each leaf 31, 32 of file folder 30 is provided with a mechanical brace 35, 36 each secured to the upper margin of the associated leaf 31, 32. Each brace 35, 36 is provided with a pair of downwardly opening channels, such as channels 37, 38 of brace 35, adjacent the opposite ends thereof and designed to receive the drawer support rails 28, 29 of the respective cabinet drawer when the file folder is installed in the drawer. Thus, the lateral spacing of channels 37, 38 of braces 35, 36 is chosen to match the lateral separation distance of drawer support rails 28, 29. In use, one or more documents are inserted into the folder space between leafs 31, 32 of the file folder 30, and the file folder 30 is installed in one of the cabinet drawers by manipulating the file folder 30 downward into the cabinet drawer until the channels 37, 38 are received by the support rails 28, 29. When the document is to be retrieved, the cabinet drawer is opened, the file folder 30 is either spread apart by the user and the desired document is removed from the folder 30, or the folder 30 itself is removed from the support rails 28, 29, spread apart, and the desired document is removed.

In order to provide some measure of security for a document storage and retrieval system of the type described above, various techniques have been introduced. One such technique uses computer controlled access to the individual file cabinet drawers. In a typical system of this type, the user enters a password and the system identifying code for the file folder or document being sought into a computer terminal connected to a system computer. If the password permits access to the system by the user, the system computer searches a system data base for the cabinet and drawer location of the item being sought and, if a match is found, signals the cabinet in which the item resides to illuminate the visible indicator device 27 on the drawer front of the drawer containing the file folder 30 in which the sought item is located and to unlock the drawer containing the sought item. The user is then permitted to open the drawer and search for the file folder. Once the file folder is located, the user can then extract the document sought. If the user disconnects any file folder brace from the support rails 28, 29 during this process, this event is detected by sensing circuitry in the cabinet and information regarding the identity of the disconnected file folder is transmitted back to the system computer.

Another security technique used either alone or in combination with the first technique described above employs a bar code reader mounted in each cabinet drawer in combination with individual bar code labels secured to the file folders. Whenever a file folder is removed from a drawer, the bar code reader reads the label and conveys the identity of the removed file folder to the system computer, which can time stamp the information for later analysis.

While the file cabinet/file folder arrangement described above with reference to FIGS. 1 and 2 has been widely adopted for document storage and retrieval purposes, it poses document security risks which are inherent in the folder 30 design. Specifically, once a user has obtained access to a collection of file folders in an opened cabinet drawer, any document in any file folder can be easily removed by simply manually spreading the two file folder braces apart and extracting the contents of the file folder. During this process, the file folder can remain inside the drawer with the brace channels engaged with the support rails 28, 29. Consequently, neither of the two security techniques described above can detect unauthorized removal of a document from a file folder.

SUMMARY OF THE INVENTION

The invention comprises a document receptacle for use in a document storage and retrieval system using file cabinets with slidable drawers having laterally spaced support rails which provides improved document security by requiring physical removal of the document receptacle from the drawer support rails in order to allow extraction of a document from the receptacle.

In a broadest aspect, the invention comprises a secure document receptacle for use in file cabinets having slidable drawers with laterally spaced folder support rails for providing removable storage for document receptacles, the secure document receptacle comprising a main body portion having a top edge, a bottom edge and opposing side edges; a support brace secured to the top edge, the support brace having laterally spaced downwardly opening channels engageable with support rails in a cabinet drawer; the top edge of the main body portion being closed; and an opening in one of the side and the bottom edges for providing access to the interior of the receptacle for insertion and removal of documents so that a document can only be removed from the interior of the receptacle via the opening. The opening in the main body portion may be formed in one of the opposing side edges, both of the opposing side edges, or the bottom edge. The open one of the side edges and the bottom edge can be provided with an enclosure mechanism for enabling the open edge to be opened and closed manually. The support brace is preferably secured within a folded over portion of the top edge.

The invention requires that a document receptacle be either partially or completely removed from a file cabinet drawer before a document may be removed from the receptacle. This ensures that contact between the support brace channels and the cabinet drawer support rails will be interrupted whenever a document is removed from a receptacle. This event can be reliably detected by cabinet sensing circuitry, thus guaranteeing that no document can be removed without detection.

For a fuller understanding of the nature and advantages of the invention, reference should be made to the ensuing detailed description taken in conjunction with the accompanying drawings.

DETAILED DESCRIPTION OF THE PREFERRED EMBODIMENTS

Figure 1:
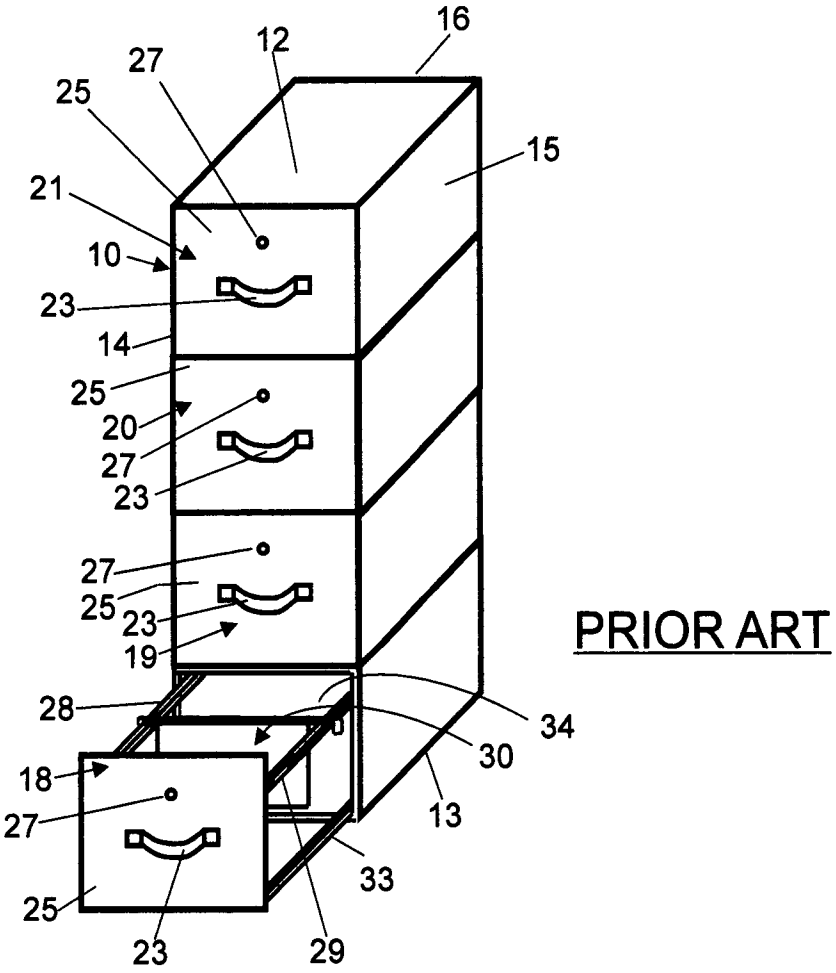
FIG. 1 is a perspective view of a prior art multiple drawer file cabinet for removably storing file folders for documents.
Figure 2:
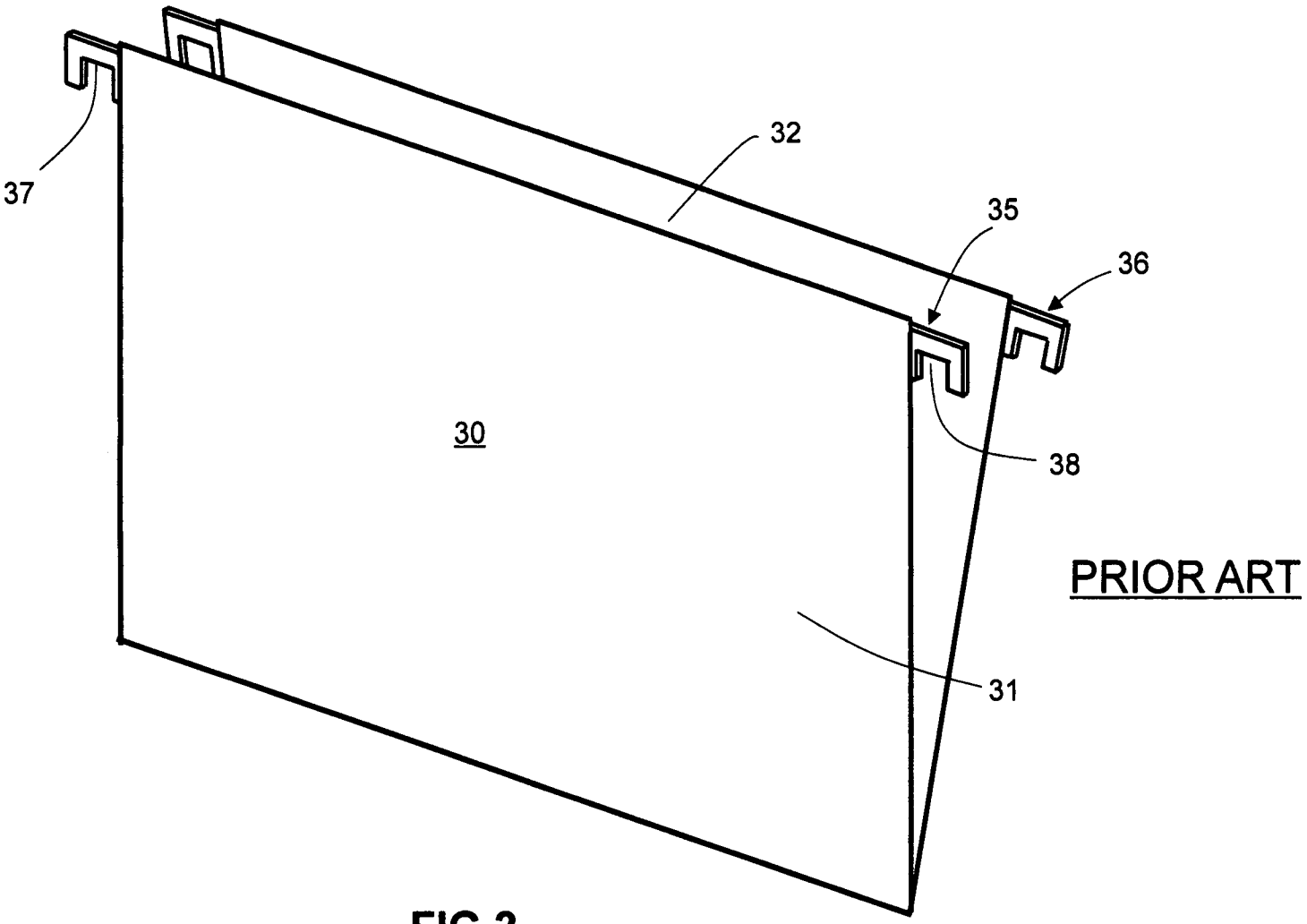
FIG. 2 is a perspective view of a prior art file folder designed for use with the file cabinet of FIG. 1.
Figure 3:
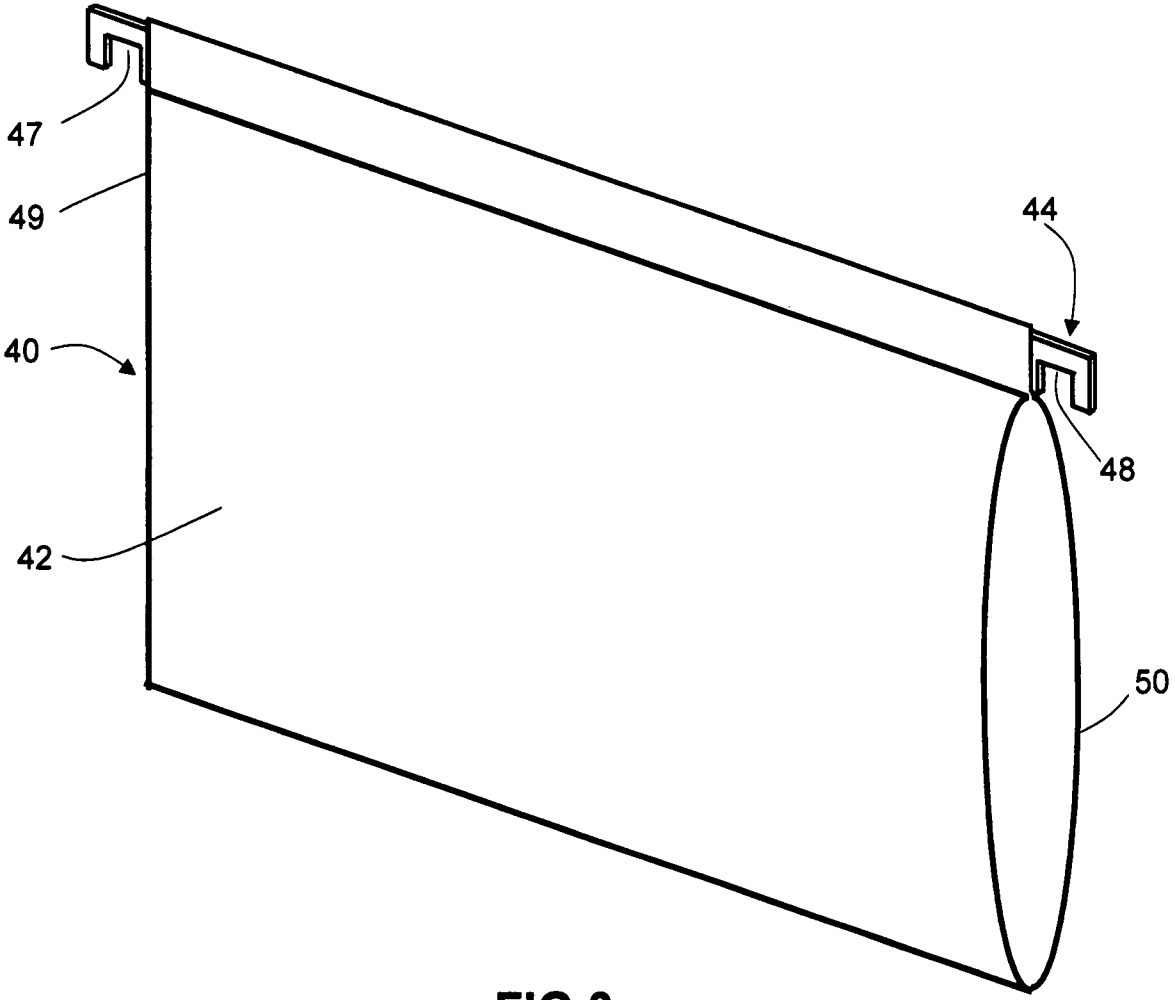
FIG. 3 is a perspective view of a first embodiment of the invention.

The invention is designed for use in a file cabinet of the type shown in FIG. 1 and is intended to be a replacement for the prior art type of file folder shown in FIG. 2. FIG. 3 is a perspective view, taken from the right front, of a first embodiment of the invention. As seen in this Fig., a secure document receptacle generally designated with reference numeral 40 has a main body portion 42 fabricated from a single sheet of suitable material such as the same type of durable paper stock used in the fabrication of the prior art file folder 30 of FIG. 2. Alternatively, main body portion 42 may be fabricated from a suitable sheet plastic material. Receptacle 40 is formed by folding the sheet stock about the longitudinal center and joining the upper and lower edges together. A single support brace 44 is secured to the upper edges of receptacle 40 by folding one edge of the sheet stock over the main body portion of support brace 44 and securing this one edge to the other edge of the sheet stock as shown in FIG. 3. The two edges of the sheet stock may be secured together using a suitable adhesive and pressure or heat bonding to create a secure bond between the two edges.

Support brace 44 has a pair of downwardly opening channels 47, 48, adjacent the opposite ends thereof and designed to receive the drawer support rails 28, 29 of a cabinet drawer when the receptacle 40 is installed in a drawer. Thus, the lateral spacing of channels 47, 48 of brace 44 is chosen to match the lateral separation distance of drawer support rails 28, 29.

The fabrication of receptacle 40 is completed by sealing one of the side edges of the partially formed receptacle 40, such as the left edge 49 shown in FIG. 3.

The completed receptacle 40 is closed at the top, bottom and one side edge, which restricts access to the interior of the receptacle 40 to the open side edge 50. Consequently, a document can only be inserted into or removed from a receptacle 40 via the open edge 50.

In use, with the receptacle 40 removed from a cabinet drawer, one or more documents are inserted into the interior of receptacle 40, after which the receptacle 40 can be installed in a cabinet drawer and positioned with the support brace channels 47, 48 engaged with the drawer support rails 28, 29. In this attitude, no document can be removed from the interior of the receptacle 40 unless the receptacle 40 is manipulated upwardly in the cabinet drawer a sufficient distance to allow access to the open side 50 of the receptacle 40. This guarantees that the support brace 44 will lose contact with the drawer support rails 28, 29, an event which can be detected by known sensing circuitry installed in the cabinet.

Figure 4:
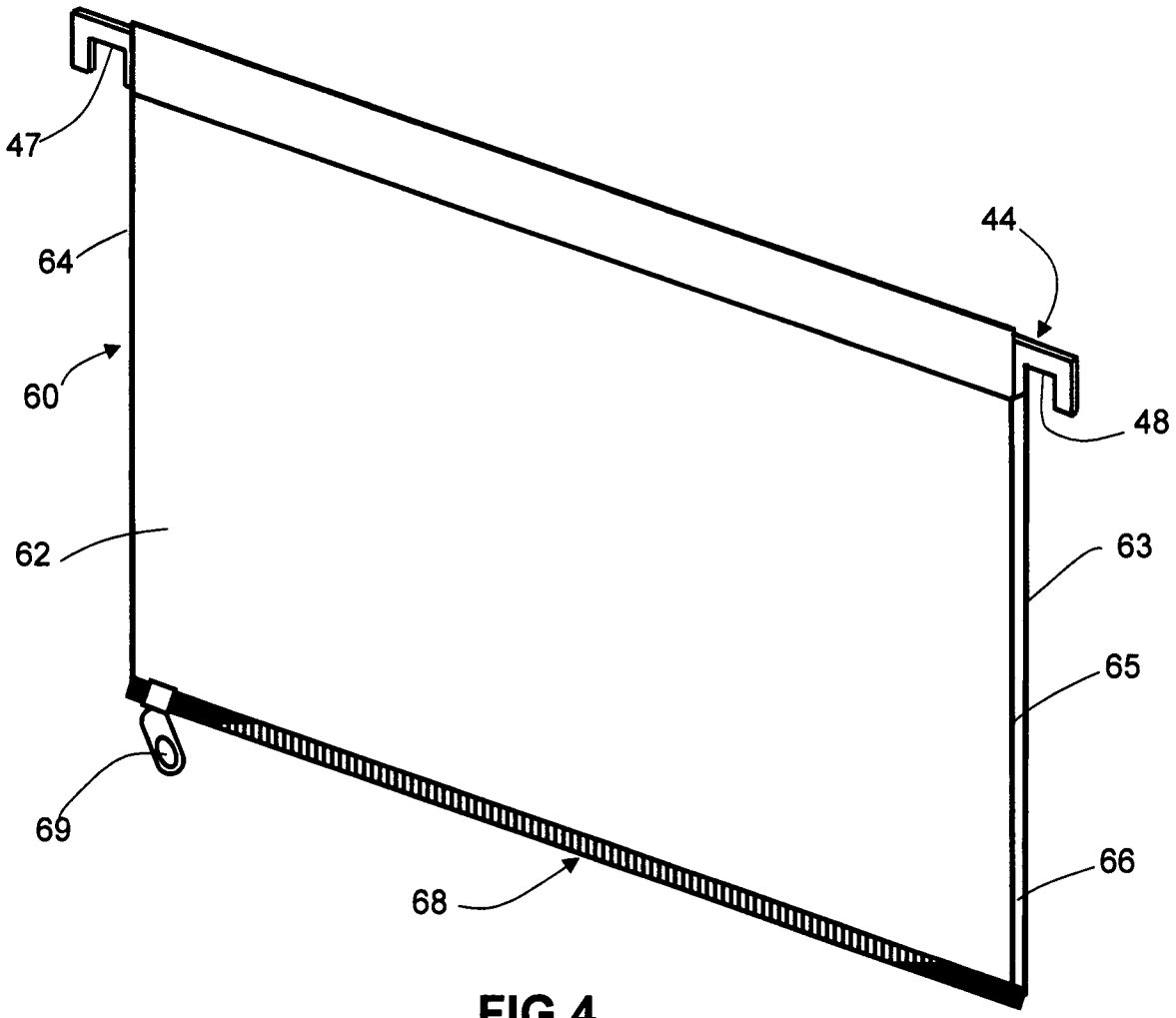
FIG. 4 is a perspective view of a second embodiment of the invention.

FIG. 4 is a perspective view, taken from the right front, of a second embodiment of the invention. As seen in this Fig., a secure document receptacle generally designated with reference numeral 60 has a front panel 62 and a rear panel 63 joined at the side edges 64, 65 by integrally formed corrugated edge filler portions 65 to provide an expandable inner volume. The top edges of panels 62, 63 are joined together and envelope a support brace 44 with downwardly opening channels 47, 48. Receptacle 60 may be fabricated from the same material as that used in the fabrication of the embodiment of FIG. 3. The bottom edges of panels 62, 63 are provided with a zipper-like enclosure mechanism having a pull tab 69. Zipper like enclosure mechanism 68 is identical in construction to the closure mechanisms used in conventional sandwich bags which enable the receptacle edges to which they are secured to be manipulated between a closed position and an opened position. The completed receptacle 60 is permanently closed at the top and both side edges, which restricts access to the interior of the receptacle 60 to the bottom edge bearing the zipper-like enclosure mechanism 68. Consequently, a document can only be inserted into or removed from a receptacle 60 via the bottom edge.

In use, with the receptacle 60 removed from a cabinet drawer, one or more documents are inserted into the interior of receptacle 60 via the bottom edge by first manipulating the enclosure mechanism 68 to the opened position, after which the documents can be inserted into the interior of receptacle 60. Receptacle 60 can then be installed in a cabinet drawer and positioned with the support brace channels 47, 48 engaged with the drawer support rails 28, 29. In this attitude, no document can be removed from the interior of the receptacle 60 unless the receptacle 60 is manipulated upwardly in the cabinet drawer a sufficient distance to allow access to the enclosure mechanism 68. This guarantees that the support brace 44 will lose contact with the drawer support rails 28, 29, an event which can be detected by the sensing circuitry installed in the cabinet.

As will now be apparent, document receptacles fabricated according to the teachings of the invention provide significant security to the storage of documents in file cabinets having slidable drawers. Specifically, no document can be removed from a receptacle installed in a cabinet drawer without first removing the receptacle at least partially (in the case of the first embodiment) or completely (in the case of the second embodiment) from the cabinet drawer in which it resides. This ensures that contact between the support brace channels of the receptacle and the cabinet drawer support rails will be broken, an event which can be reliably detected by sensing circuitry in the cabinet. Thus, no document can be removed from a receptacle without this event being detected.

Although the above provides a full and complete disclosure of the preferred embodiments of the invention, various modifications, alternate constructions and equivalents will occur to those skilled in the art. For example, while the invention has been described with reference to specific materials used in the fabrication of the main body portion of the receptacle, other suitable materials will occur to those of ordinary skill in the art. In addition, if desired the FIG. 3 embodiment may be modified by fabricating the main body portion with an open left side edge. Moreover, different types of bottom edge enclosure mechanisms may be employed in the second embodiment, such as Velcro-type strips, mechanical snaps or the like. Also, if desired the enclosure mechanism on the bottom edge of the FIG. 4 embodiment can be used on the side edge of the FIG. 3 embodiment if deemed useful. Therefore, the above should not be construed as limiting the invention, which is defined by the appended claims.

What is claimed is:

1. A secure document receptacle for use in file cabinets having slidable drawers with laterally spaced folder support rails for providing removable storage for document receptacles, said secure document receptacle comprising a main body portion having a bottom, a front panel, and a rear panel, each of said front panel and said rear panel having a top edge and laterally spaced oppositely disposed side edges; a single support brace located at said top edge, said single support brace having laterally spaced downwardly opening channels engageable with support rails in a cabinet drawer; said top edges of said front panel and said rear panel of said main body portion being permanently secured together; and an opening in only one of said side edges and said bottom for providing access to the interior of said receptacle for insertion and removal of documents, said opening extending along the length of said one of said side edges and said bottom a distance sufficient to permit insertion and removal of documents, so that a document can only be removed from said interior of said receptacle via said opening when said receptacle is at least partially raised from said support rails a sufficient distance to disconnect said support brace from at least one of said support rails.

2. The invention of claim 1 wherein said opening is formed in one of said laterally spaced oppositely disposed side edges.

3. The invention of claim 1 wherein said opening is formed in said bottom.

4. The invention of claim 1 wherein the open one of said side edges and said bottom is provided with an enclosure mechanism for enabling said open one of said side edges and said bottom to be opened and closed manually.

5. The invention of claim 4 wherein said open one of said edges is one of said side edges; and wherein said enclosure mechanism is provided on said open one of said side edges.

6. The invention of claim 4 wherein said open one of said side edges and said bottom is said bottom; and wherein said enclosure mechanism is provided on said bottom.

7. The invention of claim 1 wherein said support brace is positioned within a folded over portion of said top edge.

8. The invention of claim 7 wherein said support brace is secured to said folded over portion of said top edge.

* * * * *